US005836117A

United States Patent [19]

Johnson

[11] Patent Number: 5,836,117

[45] Date of Patent: Nov. 17, 1998

[54] BUILDING EXTENSION

[76] Inventor: Flint Scott Johnson, 645 5th Ave. South, South St. Paul, Minn. 55075

[21] Appl. No.: 508,439

[22] Filed: Jul. 28, 1995

[51] Int. Cl.[6] ..... E06B 1/38

[52] U.S. Cl. ..... 52/201; 52/202; 52/204.5; 52/204.71; 52/204.591; 52/204.69; 52/58; 52/483.1

[58] Field of Search ..... 52/201, 204.5, 52/204.71, 202, 85, 204.591, 90.1, 204.599, 204.69, 98, 100, DIG. 17, 483.1, 58; 49/501, DIG. 1, DIG. 2

[56] References Cited

U.S. PATENT DOCUMENTS

| | | | |
|---|---|---|---|
| 3,148,479 | 9/1964 | D'Amato | 52/201 X |
| 3,652,380 | 3/1972 | Strack | 52/204.591 X |
| 3,659,896 | 5/1972 | Smith et al. | 52/204.591 X |
| 4,009,546 | 3/1977 | Buck, Jr. | 52/201 |
| 4,682,451 | 7/1987 | Hubble | 52/201 X |
| 4,796,400 | 1/1989 | Mulder | 49/DIG. 1 X |
| 4,873,803 | 10/1989 | Rundo | 52/202 |
| 5,099,623 | 3/1992 | Smith et al. | 52/201 |
| 5,383,312 | 1/1995 | St. Louis et al. | 52/202 X |
| 5,421,130 | 6/1995 | Weber et al. | 52/204.591 X |

FOREIGN PATENT DOCUMENTS

| | | | |
|---|---|---|---|
| 291384 | 3/1990 | Japan | 52/201 |

*Primary Examiner*—Creighton Smith
*Assistant Examiner*—W. Glenn Edwards
*Attorney, Agent, or Firm*—Jacobson & Johnson

[57] ABSTRACT

A building extension having an external frame for supporting flat panels thereon with the flat panels secured to the external frame by a double-sided adhesive foam tape and having caps and flashings secured to the flat panels through use of double-sided adhesive fasteners to provide a waterproof roof unit which an individual can quickly and easily replace.

19 Claims, 3 Drawing Sheets

BUILDING EXTENSION

FIELD OF THE INVENTION

This invention relates generally to building extensions and, more particularly, to building extensions with a plurality of flat panels such as see-through panels mounted external to the frame of the building extension.

BACKGROUND OF THE INVENTION

The concept of building extensions with flat panels is old in the art. One of the preferred building extensions has see-though panels such as glass sheets mounted on the roof to permit sunlight to enter. Briefly, the see-through panels, such as glass panel, are mounted in a recess in a frame and secured in the frame by stops and sealant. One of the difficulties with the prior-art building extensions is that the panels are difficult to seal and frequently leak as the direct exposure to the rain and the sun causes separation between the glass panels and the frame which results in leakage around the panels. In addition it is difficult to replace the panels if one happens to be damaged as the panels are usually mounted in recess frames with stops extending along all the edges. The present invention provides an improved building extension that supports and resiliently holds the panels on the outside of the building frame to provide a waterproof enclosure and to also provide access for quickly replacing any panel. The present invention can be used in combination with a bay window to provide a unique building extension with both a see-through roof and see-through walls.

SUMMARY OF THE INVENTION

Briefly, the invention comprises a building extension having an external frame for supporting flat panels thereon. An adhesive fastener and sealant coact to secure the panels to the frame in a waterproof relationship. In addition, caps and flashings are secured to the edges of the panel through use of adhesive fasteners and sealants to provide a waterproof unit which enables quick and easy replacement of a damaged panel.

DESCRIPTION OF THE PREFERRED EMBODIMENT

Figure 1:
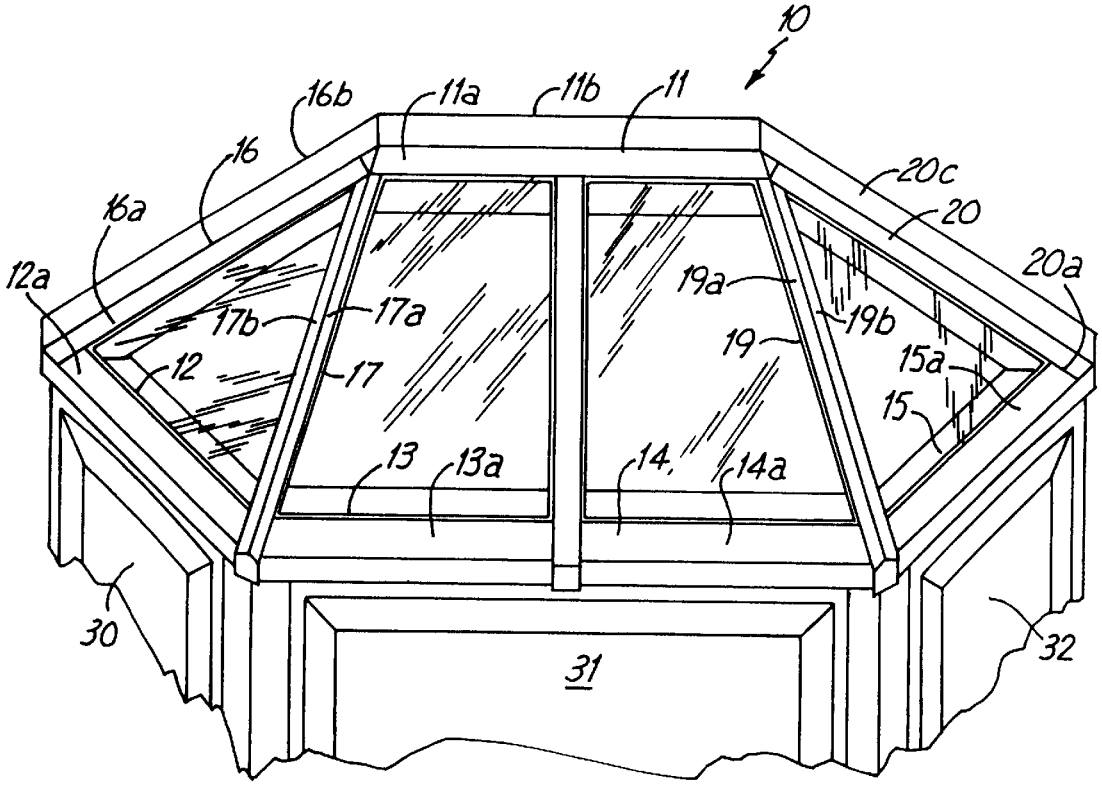
FIG. 1 shows a front perspective of the building extension with a frame for supporting a plurality of flat panels thereon.

FIG. 1 reference numeral 10 generally identifies a building extension roof support frame for holding a plurality of flat panels external to the frame. The flat panels can be see-through panels made of glass or the like. In the preferred embodiment clear glass panels are mounted externally to the frame to provide a roof structure to enable sunlight to penetrate therethrough.

Frame 10 includes a top support member 11 having a top panel support surface 11*a*, a bottom support member 12 having a top panel support surface 12*a*., a bottom support member 13 having a top support surface 13*a*., a bottom support member 14 having a top panel support surface 14*a* and a bottom support memeber 15 having a top panel support surface 15*a*. Each of panel support faces 12*a*, 13*a*,14*a* and 15*a* are the most external portions of the support members.

Extending from top support member 11 to lower support members 12, 13, 14, and 15 are a set of intermediate support members each having a top panel support face. Intermediate support member 16, which has a top panel support face 16*a*, is normally fastened to the side of a building to partially support one side of the building by a flashing 16*b* extension frame 10. Similarly, and intermediate support member 20, which has a top panel support face 20*a*,is also normally fastened to the side of a building to partially support the opposite side of the building extension frame 10. Located in a free-spanning relationship are three intermediate support members, a first intermediate support member 17 having a panel support face 17*a* and 17*b* extending from top support member 11 to lower support members 12 and 13; a second intermediate support member 18 extending from top support member 11 to lower support members 13 and 14; a third intermediate support member 19 extending from top support member 11 to lower support members 14 and 15. The top support members 11, the intermediate support members 16, 17, 18, 19 and 20 and the lower support members 12, 13, 14, and 15 coact to provide support surfaces for flat panels. Each of panel support faces 16*a*, 17*a*, 18*a*, 19*a* and 20*a* are the most external portion of the support members. Furthermore, the contiguous support members form a support surface extending in a single plane so that when a flat panel is placed thereon, the panel contacts each of the support surfaces. While a roof structure with space for four panels is shown, a frame with positions for more of fewer panels could be used.

In order to fasten the building extensions to the wall of a building a set of flanged flashings is used. FIG. 1 shows that attached to member 16 is a flanged flashing 16*a*, attached to member 11 is a flanged flashing 11*b* and attached to member 20 is a flanged flashing 20*c*.

Located below the frame are side walls 30, 31 and 32 which may be glass panels or windows.

Figure 2:
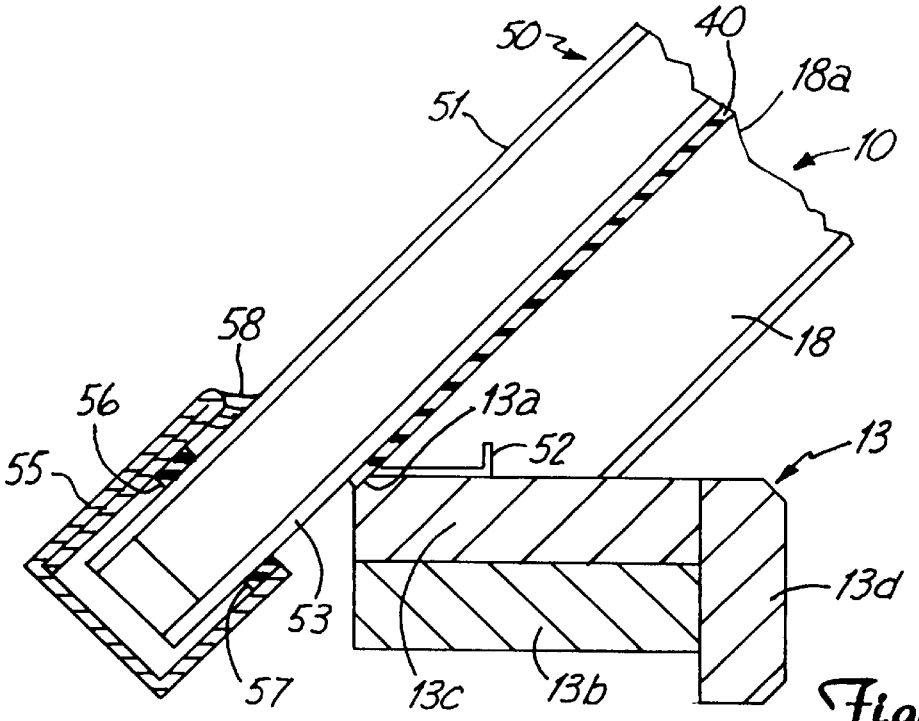
FIG. 2 shows a partial sectional view of th lower portion of the frame supporting a plurality of flat panels thereon.

To show how the support members of the frame coact to support flat panels such as see-through panels thereon, refer to FIG. 2 which shows a cross-sectional view of a lower portion of roof frame 10 together with a see-through composite glass panel supported externally of frame 10.

Lower support member 13 comprises a member formed from a first wood strip 13*b*, a second wood strip 13*c* and a mull casing 13*d* with strips 13*c* and 13*b* laminated together to form a straight support member that resists bending and bowing. Located on top of member 13*c* is a condensation gutter 52 that allows moisture to condense and evaporate therefrom. A top support surface 13*a* provides a means for supporting a panel external of support member 13. Extending upward at an angle from member 13 is intermediate support member 18 having a top surface 18*a* for supporting a panel external of support member 18. Located on support surface 18*a* is a double-sided closed cell foam tape 40 having a pressure-sensitive adhesive on opposite sides of tape 40. The adhesive on one side of tape 40 secures tape 40 to the top surface 18*a* while the adhesive on the opposite side secures panel 50 to tape 40. Thus, the double-sided foam tape both secures and cushions the panels external to frame 10.

In the embodiment shown, glass panel 50 includes a first outer sheet of glass 51, preferably tempered glass, and a lower sheet of glass 53. Located along the lower end of glass panel 50 is a U-shaped end cap 55 that extends over the end of glass panel 50 to protect the edge of the glass panel. End cap 55 is held in spaced position from the glass panel 50 by a strip of closed cell, double-sided tape 57 which secures one side of U-shaped end cap to glass 53, and a second strip of closed cell, double-sided tape 56 that secures the opposite side of U-shaped end cap to glass member 51. To prevent water from entering the U-shaped end cap 55 and to provide additional means for holding the panel 50 in places there is provided a bead of sealant 58 such as clear silicone sealant or the like. Sealant bead 58 extends along the top of U-shaped member 55 and panel 51 and adheres to both end cap 55 and top glass sheet 51.

FIG. 2 shows that the composite glass roof panel 50 is only and entirely supported external to the top surfaces of frame 10 by the use of the double-sided adhesive tape 40. That is, surfaces 13*a* and 18*a* provide support for glass panel 50. End cap 55 is held on panel 50 by the coaction of strips of double-sided adhesive tape 56 and 57 and sealant bead 58. The double-sided adhesive tape is preferably a closed-cell foam tape having a minimum thickness of approximately ⅛ inch. The double-sided tape is commercially available and is manufactured by Norton. The use of tape with a resilient layer of a minimum thickness of approximately ⅛ of an inch not only ensures that the panels are resiliently supported on the frame but also allows for normal frame movement due to temperature changes without unduly stressing the glass panels. In addition, the double-sided adhesive strips enable the glass panels to be completely supported and held in place external to the frame without the aid of stops or the like. The purpose of the foam tape is to provide a cushion between the glass panel and the frame.

Figure 2A:
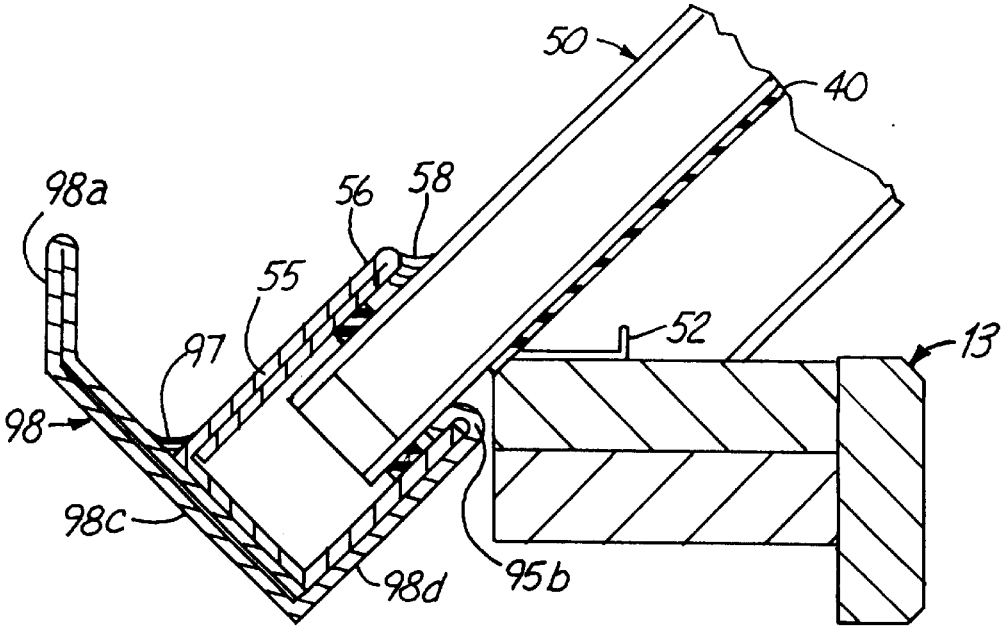
FIG. 2A shows a partial sectional view of the lower portion of the frame of FIG. 2 with a water deflector attached thereto to direct water from a door located in the building extension.

FIG. 2A shows a view identical to FIG. 2 except a water deflector 98 is mounted to end cap to direct water along the lower portion of end cap 55 and away from a door opening located in the building extension. Water deflector includes a first member 98*a* which projects vertically upward, a second member 98*c* that is coextensive with the end of end cap 55, a lower member 98*d* and a hook shaped end 95*b* for fastening over the end of end cap 55 to mechanically hold one end of deflector on end cap 55. A layer of sealant 97 extends along the junction between end cap 55 and water deflector 98 to prevent water from running there between as well as to hold the end of water deflector in position on end cap 55.

Figure 3:
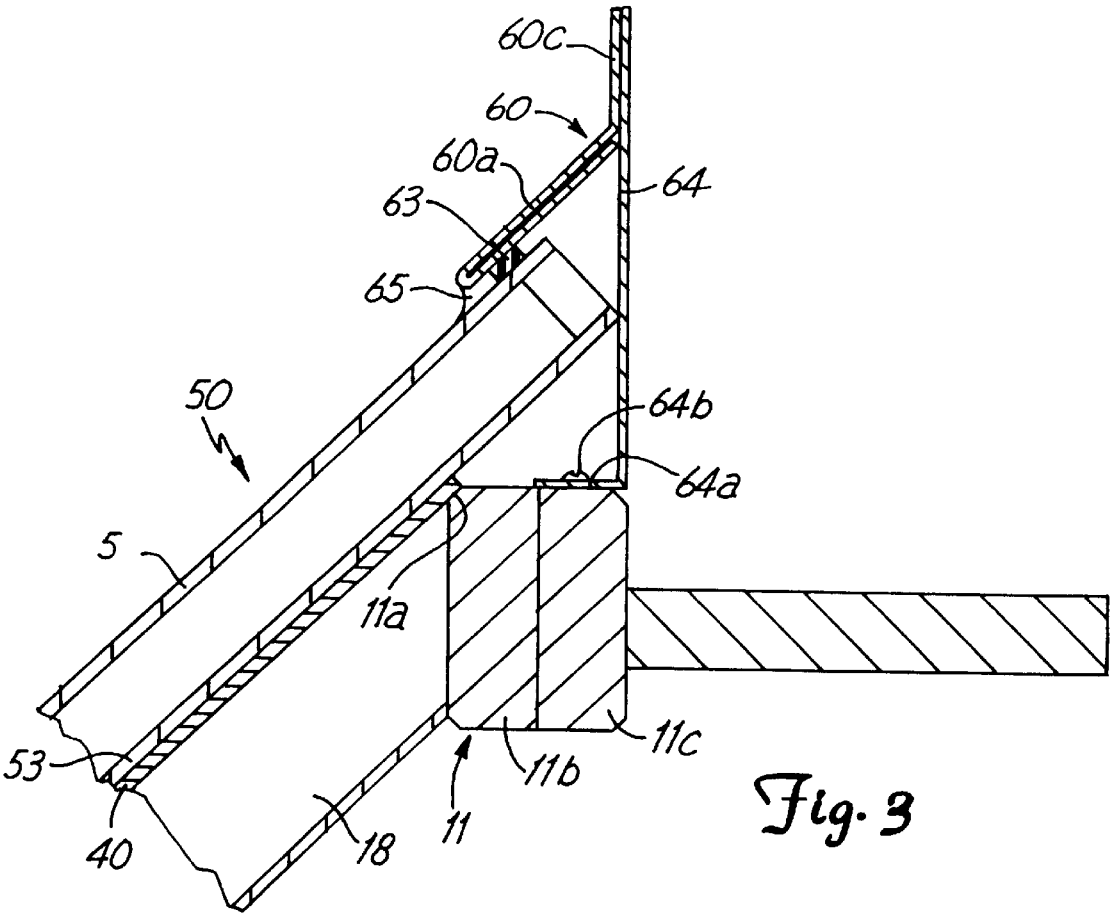
FIG. 3 shows a partial sectional view of the upper portion of the frame supporting a plurality of flat panels thereon.

FIG. 3 shows a cross-sectional view of the upper portion of frame 10 with composite see-through glass panel 50 supported externally thereon. To fasten frame 10 to building 9 the invention provides a first L-shaped flange member 64 having an extension 64*a* which is secured to top support member 11 by screws 64*b*. Top support member 11 includes strips of wood 11*b* and 11*c* which are laminated together to form a straight and stable support for composite glass panel 50.

A flangeed flashing 60 covers the top edge of panel 50. That is, the flanged flashing comprises a first portion 60*a* and a wall portion 60*c* that extends under siding to allow water to run off. A strip of double-sided foam adhesive tape 63 secures the flashing in a spaced condition to the top side of panel 50. A bead of sealant 65 is included to prevent moisture from coming under the flanged flashing 60. End caps 55 and flanged flashing 60 are preferably made from metal and are used with glass panels to protect the edges of the glass panels, but the end caps are also suitable for use with panels which are not glass.

Figure 4:
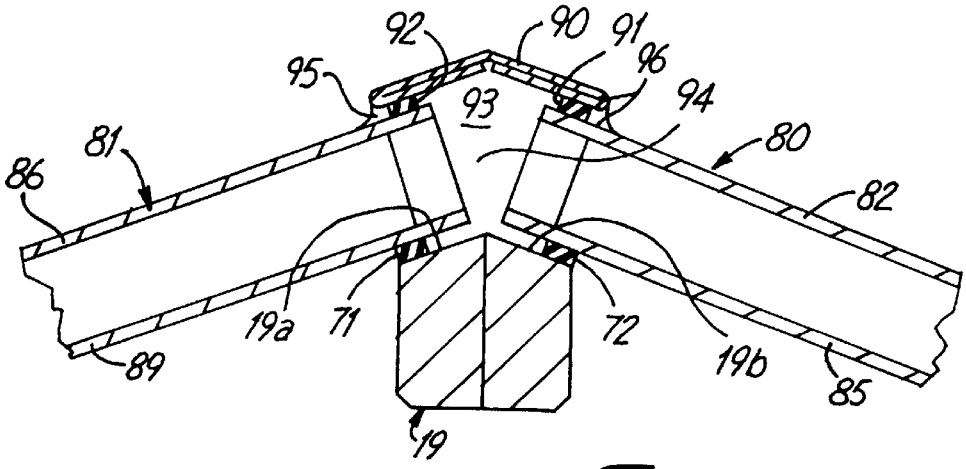
FIG. 4 shows a partial sectional view of an intermediate support member of the frame supporting the edges of two panels in angularly spaced relationship to each other.

FIG. 4 shows a portion of support frame 10 revealing how the edges of adjacent panels, which are located at less than 180-degree angles to one another, are held in a waterproof relationship to each other; for example, adjoining panels mounted on intermediate supports 17 and 19. (Note that intermediate roof support member 19 comprises two strips of wood that are laminated to each other to provide a straight support that is resistant to bending or bowing.) A top surface 19*a* includes a first strip of double-sided adhesive tape 71, and top surface 19*b* includes a second strip of double-sided adhesive tape 72. A first glass panel 80 rests on tape 72, and a second glass panel 81 rests on tape 71. Tape 71 and 72 secure the glass to the external frame and cushion the glass panel thereon.

Panel 81 includes a first outer layer of glass 86, preferably tempered glass, and a second glass layer 89. Similarly, panel 80 includes a first outer layer of glass 82, preferably tempered glass and a second glass layer 85.

Located on top of glass panels 80 and 81 is an elongated ridge cap 90 that runs the length of the glass panels and is secured external to glass panels 80 by a strip of resilient double-sided foam tape 91 and to glass panel 81 by a strip of resilient double-sided foam tape 81. A bead of sealant 95 seals one edge of ridge cap 90 to panel 81 and a second bead of sealant 96 seals the opposite side of ridge cap 90 to panel 80 to prevent moisture from penetrating under ridge cap 90. Tape 91 and 92 coact with beads of sealant 95 and 96 to hold the adjoining panels in a waterproof relationship as well as to form a continuous covering to prevent moisture from penetrating between adjacent panels.

Panels 80 and 81 are located at less than 180-degree angles to one another with the edges of the panels forming an angular shaped gap 93 therebetween that is partially filled with a sealant 94 such as silicone sealant or the like which contacts and adheres to the ends of the glass panels. The preferred sealant used in the present invention is a sealant which sets to a rubbery consistency yet has sufficient integrity and adhesive qualities to help support and hold components to the each other. Thus, with the present invention one can mount the glass panels in a waterproof relationship without the use of nails or stops.

I claim:

1. An outdoor building extension forming an enclosure comprising:

a top support member having a top external surface;

a bottom support member having a top external surface;

an intermediate support member, said intermediate support member extending from said top support member to said bottom support member and having a top external surface with said top external surfaces forming a an external frame for supporting one side of a panel external to said frame to enable a panel to be removed or replaced by lifting the panel off the external surfaces;

a layer of double-sided foam tape extending along said top surfaces, said layer of double-sided foam tape having a first adhesive on one side for securing said double-sided foam tape to said top surfaces and a second adhesive on the other side; a plurality of see-through panels located on said frame with said panels secured to said frame, with said panels secured to said foam tape by said second adhesive, said double-sided foam tape having sufficient resiliency to permit slight relative displacement between said plurality of said panels and said frame while maintaining the integrity of the plurality of panels external to said frame.

2. The building extension of claim 1 wherein the double-sided foam tape comprises the sole means for holding said panels in position on the top surfaces of said frame.

3. The building extension of claim 1 including a U-shaped end cap secured to one end of said plurality of said panels.

4. The building extension of claim 3 including a U-shaped end cap with wall flashing secured to another end of said plurality of said panels.

5. The building extension of claim 1 wherein said plurality of panels each has an edge with said edge located in an angularly spaced relationship to each other.

6. The building extension of claim 5 wherein a seam cap is located over the angular spaced edges of said plurality of panels.

7. The building extension of claim 6 including a double-sided tape securing said end cap to said plurality of panels.

8. The building extension of claim 7 wherein the double-sided tape is a closed cell foam tape.

9. The building extension of claim 8 wherein the a sealant is located in a position between the angularly spaced edges to maintain a moisture seal between adjacent panels.

10. The building extension of claim 1 including at least three panels.

11. The building extension of claim 1 wherein the panels are glass.

12. The building extension of claim 11 wherein the glass is tempered laminate glass.

13. The building extension of claim 1 wherein the support members are laminated wood to provide stability and reduce bowing.

14. An outdoor building extension forming an enclosure comprising:

a frame, said frame having panel support surfaces located external to said frame;

a panel for mounting external to said frame; and a cushion member secured to said support surfaces of said frame, said cushion member having an adhesive thereon with said adhesive member securing said panel to said frame to hold said panel external to said frame with said cushion member having sufficient thickness to permit slight relative displacement between said panel and said frame while maintaining the integrity of said panel external to said frame.

15. The building extension of claim 14 wherein the frame is a roof frame having a sloping surface for water to run off.

16. The building extension of claim 14 wherein the cushion member is a double-sided foam adhesive member.

17. The building extension of claim 14 Wherein an end cap is mounted on an edge of said panel with an adhesive fastener.

18. The building extension of claim 14 wherein there are at least two panels and each panel has an edge which is covered by an end cap, said end cap adhesively secured and covering a region between the panels to prevent water from entering between said panels.

19. The building extension of claim 14 including a water deflector for directing water laterally along the panel.

* * * * *